US009165510B2

(12) United States Patent
Dai et al.

(10) Patent No.: US 9,165,510 B2
(45) Date of Patent: Oct. 20, 2015

(54) TEMPORAL CONTROL OF ILLUMINATION SCALING IN A DISPLAY DEVICE

(75) Inventors: Min Dai, San Diego, CA (US); Ali Iranli, San Diego, CA (US); Chia-Yuan Teng, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 662 days.

(21) Appl. No.: 13/329,024

(22) Filed: Dec. 16, 2011

(65) Prior Publication Data

US 2013/0155119 A1 Jun. 20, 2013

(51) Int. Cl.
*G09G 3/30* (2006.01)
*G09G 3/34* (2006.01)

(52) U.S. Cl.
CPC ..... *G09G 3/3406* (2013.01); *G09G 2320/0247* (2013.01); *G09G 2320/0646* (2013.01); *G09G 2320/0653* (2013.01); *G09G 2320/103* (2013.01); *G09G 2340/16* (2013.01); *G09G 2360/16* (2013.01)

(58) Field of Classification Search
CPC ..... G09G 3/3406; G09G 2360/16; G09G 2320/0247; G09G 2340/16; G09G 2320/0653; G09G 2320/103; G09G 2320/0646
USPC ..... 345/690, 102
See application file for complete search history.

(56) References Cited

U.S. PATENT DOCUMENTS

| | | | | |
|---|---|---|---|---|
| 7,450,104 | B2 | 11/2008 | Baik | |
| 2005/0104839 | A1* | 5/2005 | Baik | 345/102 |
| 2005/0140631 | A1* | 6/2005 | Oh et al. | 345/89 |
| 2005/0184952 | A1* | 8/2005 | Konno et al. | 345/102 |
| 2008/0068328 | A1 | 3/2008 | Jou et al. | |
| 2008/0174607 | A1 | 7/2008 | Iranli | |
| 2008/0186413 | A1* | 8/2008 | Someya et al. | 348/739 |
| 2009/0079754 | A1* | 3/2009 | Chen et al. | 345/589 |
| 2010/0245398 | A1 | 9/2010 | Amino | |
| 2011/0013048 | A1 | 1/2011 | Wei et al. | |

FOREIGN PATENT DOCUMENTS

| | | |
|---|---|---|
| TW | 201003618 | 1/2010 |

OTHER PUBLICATIONS

International Search Report and Written Opinion—PCT/US2012/068008—ISA/EPO—Feb. 11, 2013, 10 pp.

Mark D. Fairchild, "Color Appearance Model", 2nd edition. Addison-Wesley, Jan. 2006. p. 148, Chapter 8 "Chromatic Adaptation", Section 8.1 "Light, Dark, and Chromatic Adaptation.".

* cited by examiner

*Primary Examiner* — Adam J Snyder

(74) *Attorney, Agent, or Firm* — Shumaker & Sieffert, P.A.

(57) ABSTRACT

The techniques of the disclosure are directed to reducing power consumption in a device through adaptive backlight level (ABL) scaling. The techniques may utilize a temporal approach in implementing the ABL scaling to adjust the backlight level of a display for a current video frame in a sequence of video frames presented on the display. The techniques may include receiving an initial backlight level adjustment for the current video frame and determining whether to adjust the backlight level adjustment for the current video frame based on a historical trend. The techniques may also determine the historical trend of backlight level adjustments between the current video frame and one or more preceding video frames in the sequence.

24 Claims, 7 Drawing Sheets

TEMPORAL CONTROL OF ILLUMINATION SCALING IN A DISPLAY DEVICE

TECHNICAL FIELD

The disclosure relates to display devices and, more particularly, to controlling the scaling of backlight or brightness levels in a display device.

BACKGROUND

For a wide variety of devices that include a display, power consumption often is affected by certain display characteristics, such as brightness or backlight level. Devices that include a display may include, but are not limited to digital televisions, wireless communication devices, personal digital assistants (PDAs), laptop or desktop computers, tablet computers, mobile computing devices, digital cameras, video cameras, digital media players, video gaming devices, cellular or satellite radio telephones, smartphones, navigation devices, and the like. Many such devices use backlight displays, which may also be referred to as transmissive displays.

Backlight displays, such as liquid crystal displays (LCDs), include a light source (i.e., a backlight) that illuminates optical elements of the respective displays. The optical elements of the display may receive input signals, for example, from a processor, video circuit, and/or a display driver. The input signals define the images that are to be displayed by the display. The backlight level may be adjusted to reduce power consumption caused by the backlight display.

Some displays, such as active matrix organic light emitting diode (AMOLED) displays, do not include a backlight. Instead, an AMOLED display includes individually addressable LEDs that can be selectively driven to emit light. In an AMOLED display, overall brightness of the LEDs may be adjusted to reduce power consumption by the display. However, maintaining acceptable visual quality of the displayed images while changing the backlight or brightness level can be challenging for a variety of reasons.

SUMMARY

In general, aspects of this disclosure are directed to techniques for temporal control of backlight or brightness scaling in a display device. The techniques utilize a temporal domain approach in performing adaptive backlight or brightness level (ABL) scaling. Brightness or backlight level associated with a display device may be referred to generally as illumination level. According to this temporal approach to ABL scaling, temporal information associated with a series of video frames may be used to implement adjustments to reduce illumination while reducing impact on visual quality of the displayed video frames. In some examples, temporal filtering may be used to control illumination adjustment transitions among the video frames to thereby reduce visible flickering in a sequence of video frames.

In one example, this disclosure is directed to a method of controlling an illumination level of a display, the method comprising determining a historical trend of illumination level adjustments between a current video frame in a sequence of video frames to be presented by the display and one or more preceding video frames in the sequence, and determining an illumination level for the current video frame based on the historical trend.

In another example, this disclosure is directed to a device for displaying a current video frame in a sequence of video frames presented by the device, the device comprising one or more processors configured to determine a historical trend of illumination level adjustments between a current video frame in a sequence of video frames to be presented by the device and one or more preceding video frames in the sequence, and determine an illumination level for the current video frame based on the historical trend.

In another example, this disclosure is directed to a device for displaying a current video frame in a sequence of video frames presented by the device, the device comprising means for determining a historical trend of illumination level adjustments between a current video frame in a sequence of video frames to be presented by the display and one or more preceding video frames in the sequence, and means for determining an illumination level for the current video frame based on the historical trend.

The techniques described in this disclosure may be implemented in hardware, software, firmware, or any combination thereof. If implemented in software, the software may be executed in a processor, which may refer to one or more processors, such as a microprocessor, application specific integrated circuit (ASIC), field programmable gate array (FPGA), or digital signal processor (DSP), or other equivalent integrated or discrete logic circuitry. Software comprising instructions to execute the techniques may be initially stored in a computer-readable medium and loaded and executed by a processor.

Accordingly, this disclosure is also directed to a computer-readable medium comprising instructions that, when executed, cause a processor in a device for displaying a current video frame in a sequence of video frames presented by the display to determine a historical trend of illumination level adjustments between a current video frame in a sequence of video frames to be presented by the display and one or more preceding video frames in the sequence, and determine an illumination level for the current video frame based on the historical trend.

The details of one or more examples of the disclosure are set forth in the accompanying drawings and the description below. Other features, objects, and advantages of the disclosure will be apparent from the description and drawings, and from the claims.

DETAILED DESCRIPTION

Figure 1A:
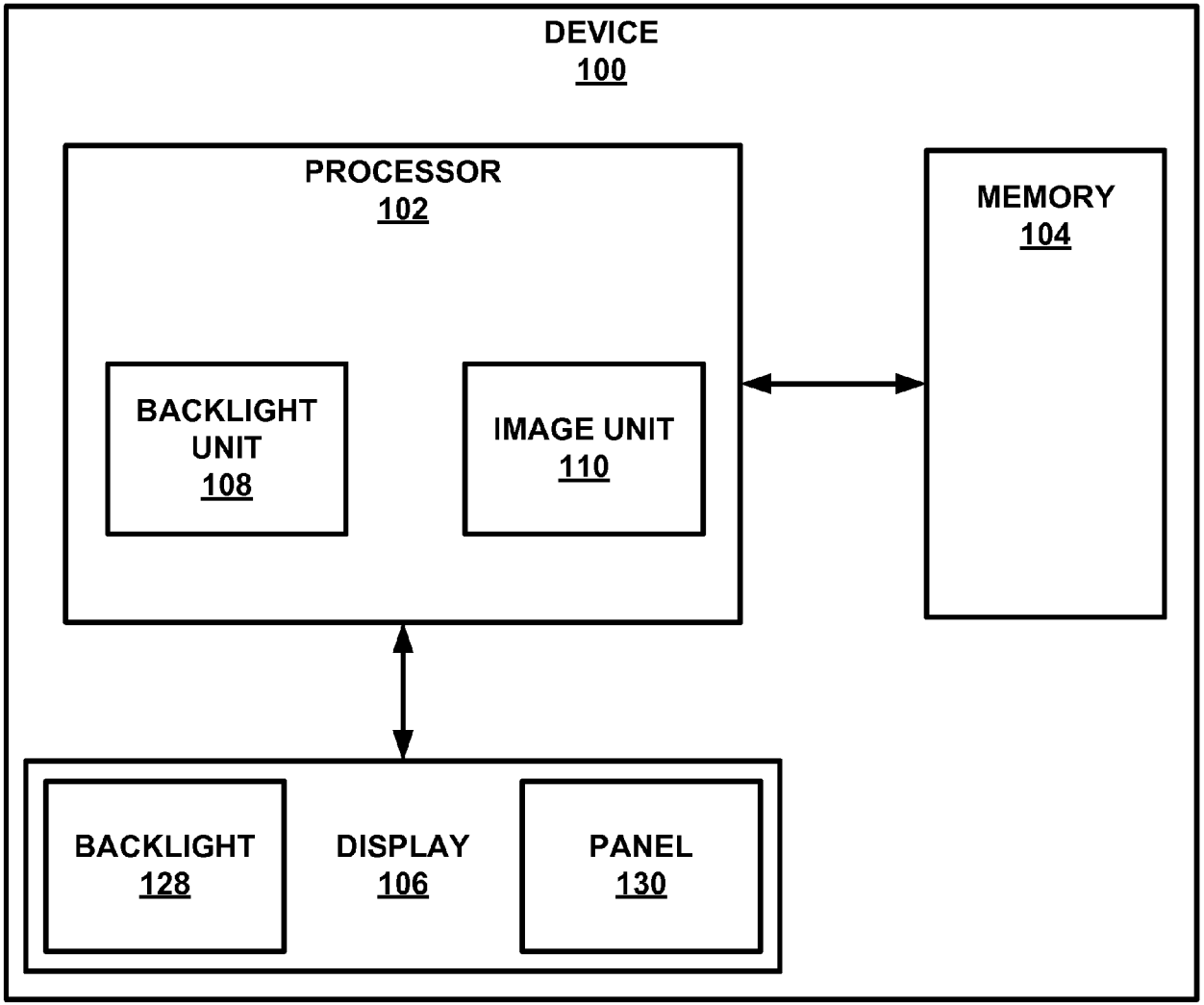
FIG. 1A is a block diagram illustrating an example device that may be used to implement the techniques of this disclosure.

Energy consumption is important for various computing devices, and it is especially important for mobile devices, which are typically battery-powered. Mobile devices, as an example, are often designed to include measures to reduce the amount of energy consumption and thereby extend battery life. One such measure is backlight modulation, e.g., reduction in backlight, for displays that make use of backlighting. The ability to reduce backlight levels may be helpful in reducing power consumption by a display, and extending battery life of the mobile device incorporating the display. However, backlight modulation may affect the visual quality of the displayed objects. Therefore, it may be desirable to adjust the backlight of a display, while minimizing the impact on the visual quality of displayed objects. In some examples, the device may utilize brightness, instead of backlight, however, the same concerns may apply to devices with brightness-based displays.

Adaptive backlight (or brightness) level (ABL) scaling is a feature used in displays of computing devices, and more particularly, in devices with power constraints, e.g., mobile computing devices. Reducing the backlight level of a display, such as an LCD, for example, may cause degradation to the visual quality of displayed images. Therefore, ABL is used to reduce the amount of backlight of a display, while minimizing the impact on the visual quality of displayed objects. Adaptive backlight scaling is applicable to LCDs, or other backlight displays. Adaptive brightness scaling is applicable to displays in which the intensity of light emitting elements can be selectively controlled, active-matrix organic light-emitting diode (AMOLED) displays. While this description discusses the techniques in terms of backlight scaling, for purposes of illustration, it should be understood that the same techniques may be applicable to brightness scaling. Furthermore, while the following discussion presents a display with global backlight change (e.g., same backlight level for the whole display panel) as an example, the techniques of this disclosure can be similarly applied to displays with local backlight changes (e.g., different areas of the display panel have different backlight levels). In some examples, backlight level and brightness level may be referred to generally as illumination level.

Some systems may implement ABL scaling algorithms that reduce the backlight level and adjust pixel values to compensate for the reduced visual quality resulting from the backlight level reduction. Hence, the pixel values may be adjusted as a function of backlight level. The pixel value adjustment is performed in the spatial domain. In particular, the pixel values may be adjusted within a given image, such as a video frame, without regard to pixels values in other video frames, e.g., preceding or successive video frames. Typically, ABL scaling algorithms include histogram calculation (e.g., provides representation of intensity distribution), backlight calculation (e.g., determination of backlight level), and pixel remapping (e.g., mapping input pixels to output pixels). These steps may be performed on each frame, thus reducing the backlight level while reducing the impact on the quality of the frame by adjusting the pixel values. However, existing algorithms are applied on a frame-by-frame basis, i.e., independently for each frame without regard to other frames. As a result, while the visual quality of each frame may be acceptable, backlight adjustments may cause the visual appearance of flickering occur in a sequence of frames. In particular, the backlight level may change noticeably from frame-to-frame, causing the displayed video frames to flicker.

This disclosure describes a temporally-refined ABL algorithm. In some examples, according to this temporal approach to ABL scaling, temporal information associated with a series of video frames may be used to implement backlight or brightness adjustments to reduce backlight or brightness while reducing impact on visual quality of the frames. In particular, temporal filtering may be used to control backlight or brightness adjustment transitions among the frames to thereby reduce the visual appearance of flickering in a sequence of frames presented on the display.

FIG. 1A is a block diagram illustrating an example device 100 that may be used to implement the techniques of this disclosure. Device 100 may be a stand-alone device or may be part of a larger system. In some examples, device 100 may comprise a mobile computing device, such a wireless communication device (such as a so-called smartphone), a digital media player, a mobile television, a gaming device, a navigation device, a digital camera or other video device. In one aspect, device 100 may be included in one or more integrated circuits or integrated circuit chips. Device 100 may include a display built into device 100. In other examples, device 100 may be a host device that drives a display coupled to the host device. In some examples, where a display is built into a device, a processor in the device may implement the techniques of this disclosure. In another example, where a host device is coupled to a display, a processor in the host device may implement the techniques of this disclosure, or a processor in the display device may implement at least a portion of the techniques of this disclosure.

Device 100 may be capable of processing a variety of different data types and formats. For example, device 100 may process still image data, audio data, video data, or other multi-media data. In the example of FIG. 1, device 100 may include, among other components, processor 102, memory 104, and display 106. As FIG. 1A shows, processor 102 may comprise backlight unit 108 and image unit 110, and display 106 may comprise backlight module 112 and panel module 114. While the following discussion utilizes the example of backlight level, it should be understood that the same concepts are applicable to brightness level associated with certain types of displays, and to illumination levels associated with display devices generally.

In one example, processor 102 may be a mobile display processor (MDP). Device 100 may include a variety of processors, such as a central processing unit (CPU), digital signal processor (DSP), graphics processing unit (GPU), audio, image and video encoder/decoder units (CODECs), a modem, or the like. The functionality associated with processor 102 may be provided within a dedicated display processor or within one or more of the above processors or other processing circuitry. Processor 102 may be a processor associated with device 100. In other examples, where display 106 may be an external or a separate display device coupled to device 100, instead of built into device 100, processor 102 or at least a portion of the processing performed by processor 102 may be performed by a processor built into display 106.

Device 100 may be capable of executing various applications, such as graphics applications, image applications, video applications, communication applications, or other multi-media applications. For example, device 100 may be used for image applications, audio/video applications, video game applications, video applications, digital camera applications, instant messaging applications, mobile location applications, or the like.

Memory 104 may store instructions that, when executed by processor 102, define units 108 and 110 within processor 102. Units 108 and 110 are shown separately in FIG. 1 for illustration purposes and may be implemented, for example, in one module in processor 102. In one example, backlight unit 108 and image unit 110 may be part of a core algorithm that implements the techniques of this disclosure.

Additionally, memory 104 may store data such as, for example, display data that may be used by processor 102 to configure display settings. In one aspect, display 106 may be a display device, such as an LCD, AMOLED, or other form of display device. Other forms of output devices may be used within device 100 including different types of display devices, audio output devices, and tactile output devices.

In one aspect, display 106 may comprise a backlight display device, such as an LCD (liquid crystal display), or other form of display device. Other forms of output devices may be used within device 100 including different types of display devices, audio output devices, and tactile output devices. Again, although display 106 is illustrated as being part of device 100, in some cases, display 106 could be an external display that is external to device 100 but driven by data that is generated by processor 102. Display 106 may include, for example, backlight module 128 and panel module 130. Backlight module 128 may apply the corresponding backlight level to display 106 based on a backlight level determined by backlight unit 108. Panel module 130 may display image content on display 106 based on image information determined by image unit 110.

During operation of device 100, processor 102 may use input data to execute one or more instructions that generate output data as a result. For example, processor 102 may receive instructions for execution from memory 104. In addition, processor 102 may receive input data used during instruction execution from memory 104 or from other applications within device 100. Processor 102 may receive, for example, input data (e.g., display data) regarding an image to be displayed on display 106. The input data may include one or more input data components. For example, the input data may be display panel data, e.g., content of an incoming image, which may be a video frame in a sequence of video frames to be presented by display 106. Other display panel data may include information associated with displaying the image content on display 106, and may be formulated based on pixel values to drive the display (e.g., LCD, OLED, etc.). Based on the content of the video frame, backlight unit 108 of processor 102 may determine an amount of adjustment to the backlight level of display 106 corresponding to the video frame.

In accordance with techniques of this disclosure, processor 102 may determine a historical trend of backlight adjustments between the video frame currently being processed and one or more preceding video frames. Processor 102 may receive or determine an initial backlight level adjustment, and determine whether to adjust the initial backlight level adjustment to produce a final backlight level adjustment for the current video frame based on the historical trend of the video frames. For example, the initial backlight level adjustment may be generated using an ABL process. Backlight unit 108 of processor 102 may then apply a temporal filtering process to readjust the initial backlight level adjustment to account for difference in backlight adjustment across two or more frames. In particular, backlight unit 108 may readjust the initial backlight level adjustment based on temporal filtering to eliminate or reduce the appearance of flicker in a series of video frames presented by display 106. Additionally, image unit 110 of processor 102 may adjust the image data, e.g., perform pixel scaling, based on the backlight level adjustment determined by backlight unit 108. Processor 102 may then provide the backlight level adjustment and the transformed image to display 106, which may present the transformed image at a backlight level adjusted by the backlight level adjustment, as described in more detail below.

Processor 102 is therefore configured to process the image data to establish a backlight level or a reduction in the backlight level at which the image is to be displayed. In one example, the backlight level may be a percentage representing the amount of backlight relative to the normal backlight or relative to a current back light level (e.g., 78%). Processor 102 applies the backlight level to display 106 when the corresponding video frame is presented for display. Processor 102 may determine adjustments to the frame, e.g., pixel scaling factor, based on the determined backlight level, and transform the original frame using the determined adjustments to the frame. Processor 102 then supplies the output image data to output device 106, which displays the output image at the associated backlight level.

In this manner, the techniques may enable processor 102 to utilize a temporal domain approach in performing adaptive backlight or brightness level (ABL) scaling. According to this temporal approach to ABL scaling, processor 102 is configured to use temporal information associated with a series of video frames to implement adjustments to reduce illumination, while reducing impact on visual quality of the displayed video frames. In some examples, this temporal filtering may be used to control illumination adjustment transitions among the video frames to thereby reduce visible flickering in a sequence of video frames.

Figure 1B:
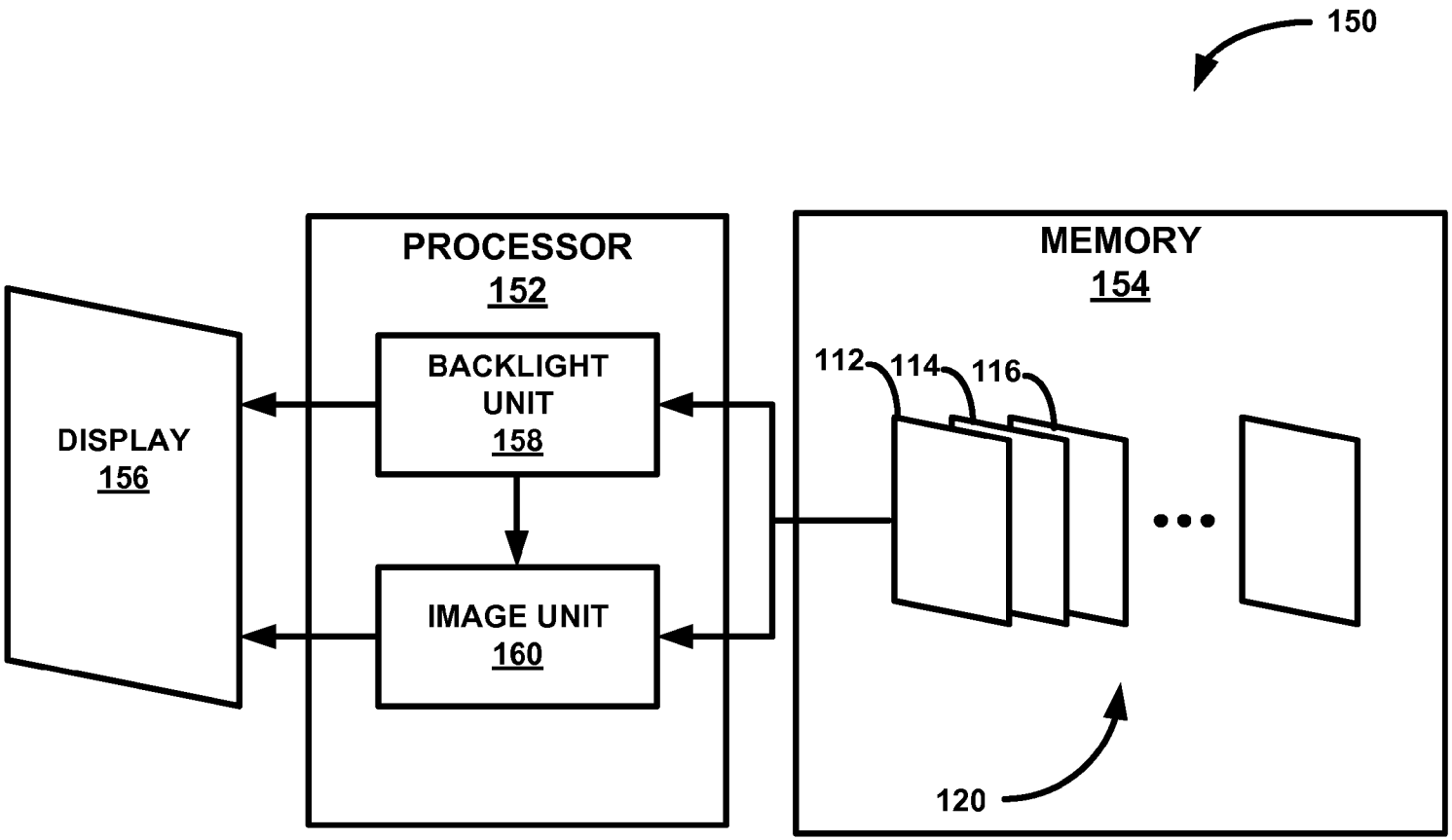
FIG. 1B is a block diagram illustrating one example configuration of a system that may be used to implement the techniques of this disclosure.

FIG. 1B is a block diagram illustrating one example configuration of a system 150 that may be used to implement the techniques of this disclosure. In one example, at least a portion of the different components of system 150 may be part of device 100 of FIG. 1A. System 150 may comprise processor 152, memory 154, and display 156, which may be similar to processor 102, memory 104, and display 106, respectively, of FIG. 1A. In one example, processor 152, memory 154, and display 156 may be part of one device, e.g., device 100 of FIG. 1A. In another example, display 156 may be a stand-alone external display device coupled to a host device that comprises processor 152 and memory 154. In yet another example, display 156 may be a stand-alone external display device coupled to a host device that comprises memory 154. In this example, each of the host device and the display device may have a processor therein. Processor 152 may therefore represent one or both processors, and at least a portion of the techniques of this disclosure may be performed by one of the processors. In this manner, processor 152 may represent one or more processors, in the host device and/or the display device.

As noted above, display 156 may be an LCD and may display input images processed by processor 152. The input images may be still or moving images, e.g., video frames. In one example, input images 120 may be a sequence of video frames processed for presentation on display 156. Backlight unit 158 and image unit 160 may represent modules or algorithms executed by processor 152, for example, and may provide information for presentation of each corresponding frame. Units 158 and 160 are shown separately in FIG. 2 for illustration purposes and may be implemented, for example, as part of a core algorithm that implements the techniques of this disclosure.

In one example, backlight unit 158 may provide backlight information to display 156, where the backlight information may include data or instructions specifying a backlight level, or an adjustment to a current backlight level, e.g., relative to a default backlight level or a current backlight level. Image unit 160 may provide image information to display 156, where the image information may include adjusted image data based on a scale factor corresponding to, or as a function of the adjustment to the backlight level of the display.

In one example, input sequence of video frames 120 may include a sequence of video frames 112, 114, 116, and so forth. Backlight unit 158 may determine, based on each input frame, certain characteristics associated with the frame, such as a histogram calculation of pixel intensity values, for example. In one example, the characteristics associated with each frame may be determined relative to neighboring frames, e.g., one or more video frames that precede a frame currently being processed. For example, each frame may have an associated histogram, which may provide a representation of the tonal distribution of the frame, e.g., in terms of intensity.

In accordance with techniques of this disclosure, backlight unit 158 may determine an initial backlight level adjustment for the current frame based on the histogram, where the initial backlight level adjustment represents the minimum required backlight level to maintain a desirable visual presentation of the current frame. In particular, the minimum required backlight level may be the lowest backlight level needed to ensure minimal impact on the visual quality of the frame, given the distribution of pixel intensity values. In one example, the minimum required backlight may be determined using a predefined threshold of distortion. In one example, the desirable visual presentation may be an indication of the predefined distortion threshold, e.g., 0.1% pixels might get saturated when displayed at the corresponding backlight level, and this 0.1% is then the predefined distortion threshold.

According to the techniques of this disclosure, backlight unit 158 may determine a historical trend of backlight level adjustments between the current frame and one or more preceding video frames in sequence 120. For example, frames 112 and 114 may be processed in that order and before frame 116. During processing of frame 116, the initial backlight level adjustment associated with frame 116 and the backlight adjustment level associated with at least frame 114 may be utilized to determine a historical trend in the backlight level adjustments of consecutive frames. Backlight unit 158 may determine whether to adjust the backlight level adjustment for the current frame based on the historical trend. In one example, the historical trend may indicate whether a first trend between an adjusted backlight level adjustment for the current video frame (e.g., frame 116) and a backlight level adjustment for a preceding video frame (e.g., frame 114) conflicts with a second trend between the backlight level adjustment for the preceding video frame (e.g., frame 114) and a backlight level adjustment for another preceding frame (e.g., frame 112).

Backlight unit 158 may also determine a relationship between consecutive frame (e.g., frames 112 and 114), where the relationship may indicate whether, for example, a scene change has occurred from one frame to another. Backlight unit 158 may determine whether there is a complete scene change, no scene change, or a partial scene change from one frame to another. If a partial or complete scene change has occurred, backlight unit 158 may adjust the backlight level of the current frame using the initial backlight level adjustment. If no scene change has occurred, backlight unit 158 may adjust the backlight level of the current frame to the backlight level of the preceding frame. Backlight unit 108 may then provide the backlight level adjustment to image unit 160, which may determine a pixel scale factor based on the backlight level adjustment. Image unit 160 may determine the scale factor, such that the visual impact of the backlight level adjustment is minimized. Image unit 160 may then transform the original frame using the determined scale factor. Backlight unit 158 may then pass backlight information, corresponding to the determined backlight level, to display 156. The backlight information may be a backlight level, a backlight level adjustment relative to a current backlight level, or a backlight level adjustment relative to the initial backlight level. Image unit 160 may pass the transformed frame to display 156, which may display the transformed frame at the backlight level.

Figure 2A:
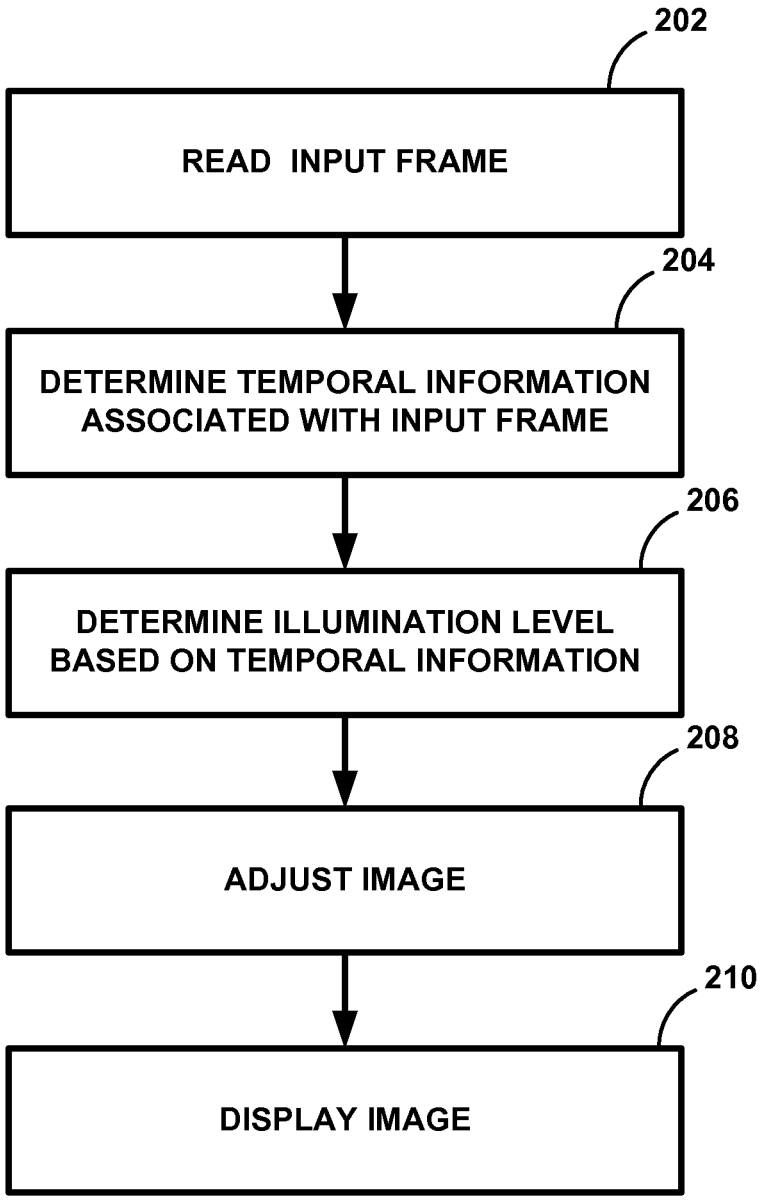
FIG. 2A is a flow diagram illustrating an example process of controlling an illumination level of a display.

FIG. 2A is a flow diagram illustrating an example process of controlling an illumination level of a display. As previously noted, illumination level may refer generally to backlight level or brightness level. The techniques of FIG. 2A will be described from the perspective of the components of FIG. 1A, although other devices and components may perform similar techniques. Device 100 may read a sequence of input video frames (202). In one example, the sequence of video frames may be provided by a video capture device connected to device 100 or built into device 100. In another example, the sequence of frames may be a streaming video or downloaded provided to device 100 through a network connection. In yet another example, the sequence of frames may be retrieved by a media application on device 100 from an external storage device connected to device 100 or internal storage, e.g., memory 104.

In one example, the sequence of video frames may be processed for presentation on display 106. Processor 102 may determine temporal information associated with the input frame (204). The temporal information may include a historical trend of illumination levels between a current input video frame from the sequence and one or more previous video frames from the sequence. The historical trend may be indicative of a relationship between frames that shows a trend of behavior of illumination level changes. Processor 102 may then determine an illumination level based on the temporal information (206). The illumination level (e.g., backlight or brightness level) may be determined to eliminate or reduce the appearance of flicker when the sequence of video frames is presented on the display.

Using the determined illumination level, processor 102 may adjust the image (208). Adjusting the image may include scaling the image pixels to account for the impact of adjusting the illumination level of the frame. Processor 102 may then send the adjusted image to a display device (e.g., display 106), which may display the image (210) at the adjust illumination level.

Figure 2B:
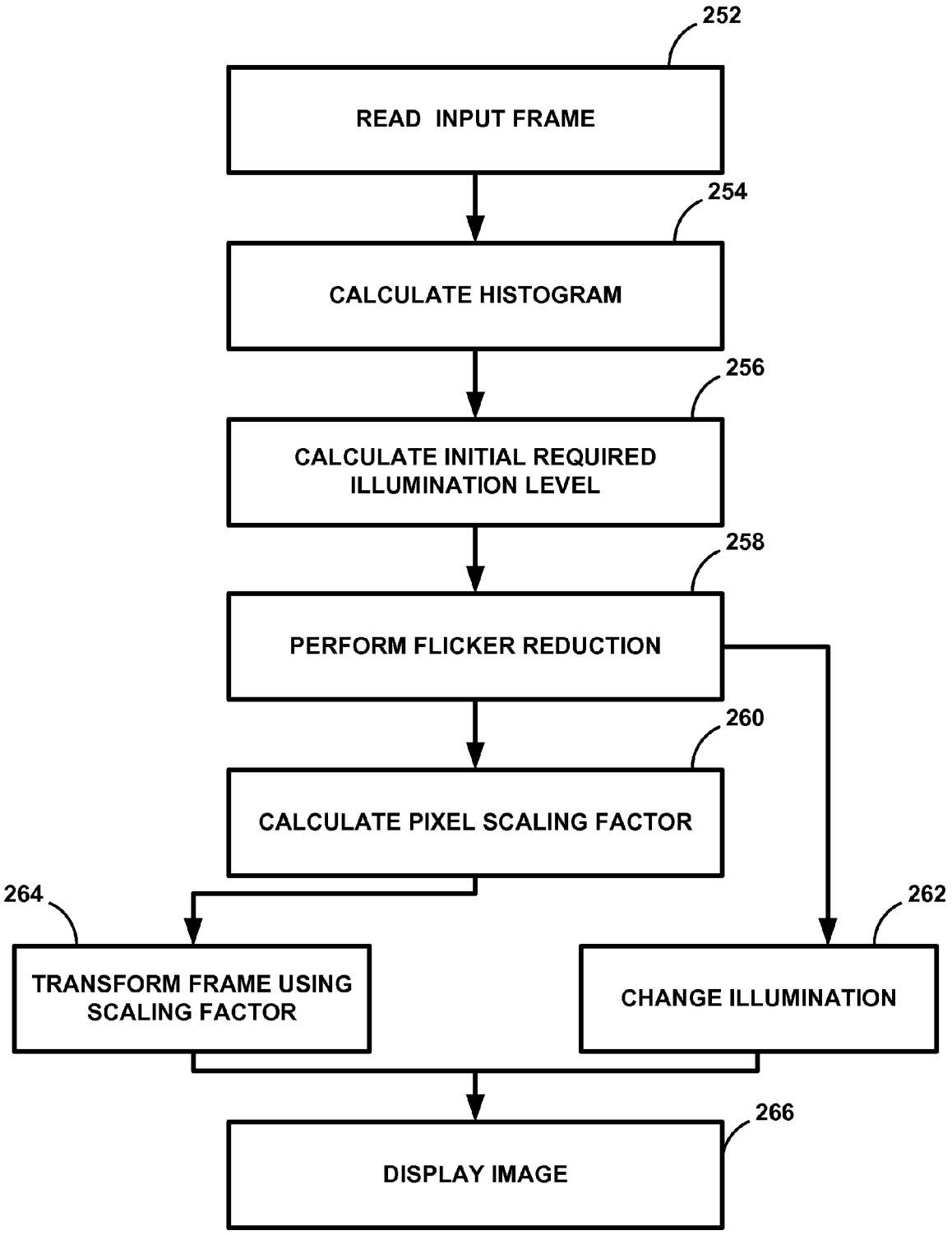
FIG. 2B is a flow diagram illustrating an example process of adjusting an illumination level of a display in the temporal domain.

FIG. 2B illustrates an example process of adjusting illumination level of a display in the temporal domain. The technique of FIG. 2B will be described from the perspective of the components of FIG. 1A, although other devices and components (e.g., FIG. 2B) may perform similar techniques. Device 100 may read a sequence of input video frames (252).

In one example, the sequence of video frames may be processed for presentation on display 106. Processor 102 may calculate a histogram of each input frame (254) using pixel data of the frame. The values used for calculating the histogram may depend on the format (e.g., color coordinate system) of pixel values of the frames, e.g., RGB, HSV, YUV, and so forth. In one example, depending on the format of the image, one of the channels (e.g., the dominant color channel) may be selected and used to calculate the histogram. The histogram presents a probability distribution of pixel intensity values for the video frame, e.g., pixel intensity values for a dominant channel. Processor 102 may then determine the threshold illumination level that would result in desirable visual presentation of the frame, based on the calculated histogram (256). In particular, the threshold illumination level may be the lowest illumination level needed to ensure minimal impact on the visual quality of the frame, given the distribution of pixel intensity values. In one example, the impact on the visual quality of a frame may be determined based on a distortion level, as discussed above, where the distortion level may be associated with a value that expresses percentage of saturated pixels in the image or a distortion percentage. For example, for bright content, the distortion percentage may be 0.1% to 1% for visual quality level high to low. In one example, the threshold illumination level may be associated with the corresponding frame as an initial illumination level or an initial illumination level adjustment relative to a default backlight level, for example. Hence, processor 102 may produce an initial illumination level, which may then be adjusted by processor 102 using temporal filtering to reduce flicker as described below.

For example, processor 102 may perform flicker reduction (258), e.g., by implementing a flicker reduction algorithm that utilizes temporal information between frames to adjust the illumination level and the pixel values of the frame, as will be described in more detail below. Processor 102 may implement the flicker reduction algorithm may determine a historical trend of illumination level adjustments between the current video frame to be displayed and one or more preceding video frames in the sequence of video frames. In implementing the flicker reduction algorithm, processor 102 may determine whether to adjust the initial illumination level (256) for the current frame based on the historical trend. When implementing the flicker reduction algorithm, processor 102 may also determine a relationship between consecutive frame (e.g., frames 112 and 114), where the relationship may indicate whether, for example, a scene change has occurred from one frame to another. Based on whether or not a scene change has occurred, processor 102 may perform the flicker reduction algorithm to adjust the illumination level using either the initial illumination level adjustment or an illumination level associated with the preceding frame.

Processor 102 may then utilize the illumination level adjustment determined when performing the flicker reduction algorithm, to calculate the pixel scaling factor (260). In one example, the pixel scaling factor may be calculated by processor 102 using a theoretical luminance model:

$$L=B*(x/255)\hat{}r,$$

where L is luminance, x is the pixel intensity value, B is the backlight level, r is the display panel gamma coefficient, and where "^" is the exponent operator. To keep the same luminance before and after backlight change, we have L=L', and the new pixel value x' may be calculated as follows:

$$x'=(B/B')\hat{}(1/r)*x,$$

where B' represents the new backlight level; so the scaling factor for x is (B/B')^(1/r).

Processor 102 may determine the calculated pixel scaling factor, such that the visual impact of the illumination level adjustment on the frame is reduced or eliminated. Processor 102 may then utilize the illumination level adjustment determined by the flicker reduction algorithm to change the illumination intensity of the frame (252). Processor 102 may also utilize the pixel scaling factor to adjust the pixel values of the frame (264). Processor 102 may then provide the adjusted illumination intensity and frame to display 106, which may then display the frame at the adjusted illumination level (266).

According to the techniques of the disclosure, in some examples, processor 102 may implement the flicker reduction algorithm to utilize temporal information associated with the frames within the sequence of video frames to reduce flicker caused by adaptation in the human visual system. In some examples, implementation of the flicker reduction algorithm may enable processor 102 to also prevent false classification in the algorithm and reduce non-uniform illumination (e.g., backlight or brightness). Additionally, processor 102, in implementing the flicker reduction algorithm, may utilize a temporal filter to remove inconsistencies between pixel adjustments among frames. In one example, the temporal filter may be a 2-tap filter, which minimizes latency caused by temporal filtering. Performing this flicker reduction algorithm may also enable processor 102 to utilize two types of temporal information: similarity check and trend of history of illumination. Details of the flicker reduction algorithm are discussed in more detail below, where it is assumed that processor 102 may implement, perform, or otherwise execute this filter reduction algorithm to carry out the functions attributed to this algorithm.

For a sequence of video frames or a set of consecutive images, there is temporal information between neighboring frames. The temporal information is considered a basic block in video compression standards (e.g., MPEG-4, H.264, or HEVC), and is used as the basis for motion estimation and motion compensation. Typically, in video compression standards, the temporal information is obtained from pixel domain calculations, which may not be possible in ABL techniques due to the high computational cost of pixel domain calculations. According to the techniques of this disclosure, temporal information computation may include two types of information: a similarity check (or scene change detection) between neighboring frames and a historical trend of illumination level. The details of the techniques will be described in more detail below using the example of backlight, but it should be understood that such techniques may be utilized with other types of illumination in display device, such as brightness, for example.

The flicker reduction algorithm may determine a degree of similarity between two consecutive frames, thus determining whether a scene change has occurred. The histograms of the frames may be used to determine the similarity, SIM, between two frames as follows:

$$SIM = \frac{H_{pre} \cdot H_{curr}}{\|H_pre\|\|H_curr\|}$$

where $H_{curr}$ may represent the histogram of the current frame (e.g., intensity values), and $H_{pre}$ may represent the histogram of a previous frame (e.g., the frame preceding the current frame in a video sequence or the image displayed prior to the current image). The above equation determines the correlation between the histogram of the current frame and the histogram of the previous frame. H is the histogram array and H[i] is the histogram value, with i indicating the index of histogram array. The function in the numerator is the sum of (Hpre[i]*Hcurr[i]) and in the denominator ||H|| indicates square root of the sum ((H[i])^2), for i=0 to n−1, for any array of n histogram values H[i]. Therefore, the value of SIM is between 0 and 1, inclusive, and the closer the value is to 1, the more similar the two frames, thus indicating less change in the scene. If a scene change occurs between the two frames, the value of SIM is low and closer to 0. In addition to determining a degree of similarity by detecting scene change, the flicker reduction algorithm may also utilize a fade-in/fade-out detection scheme, as shown in FIG. 3.

Figure 3:
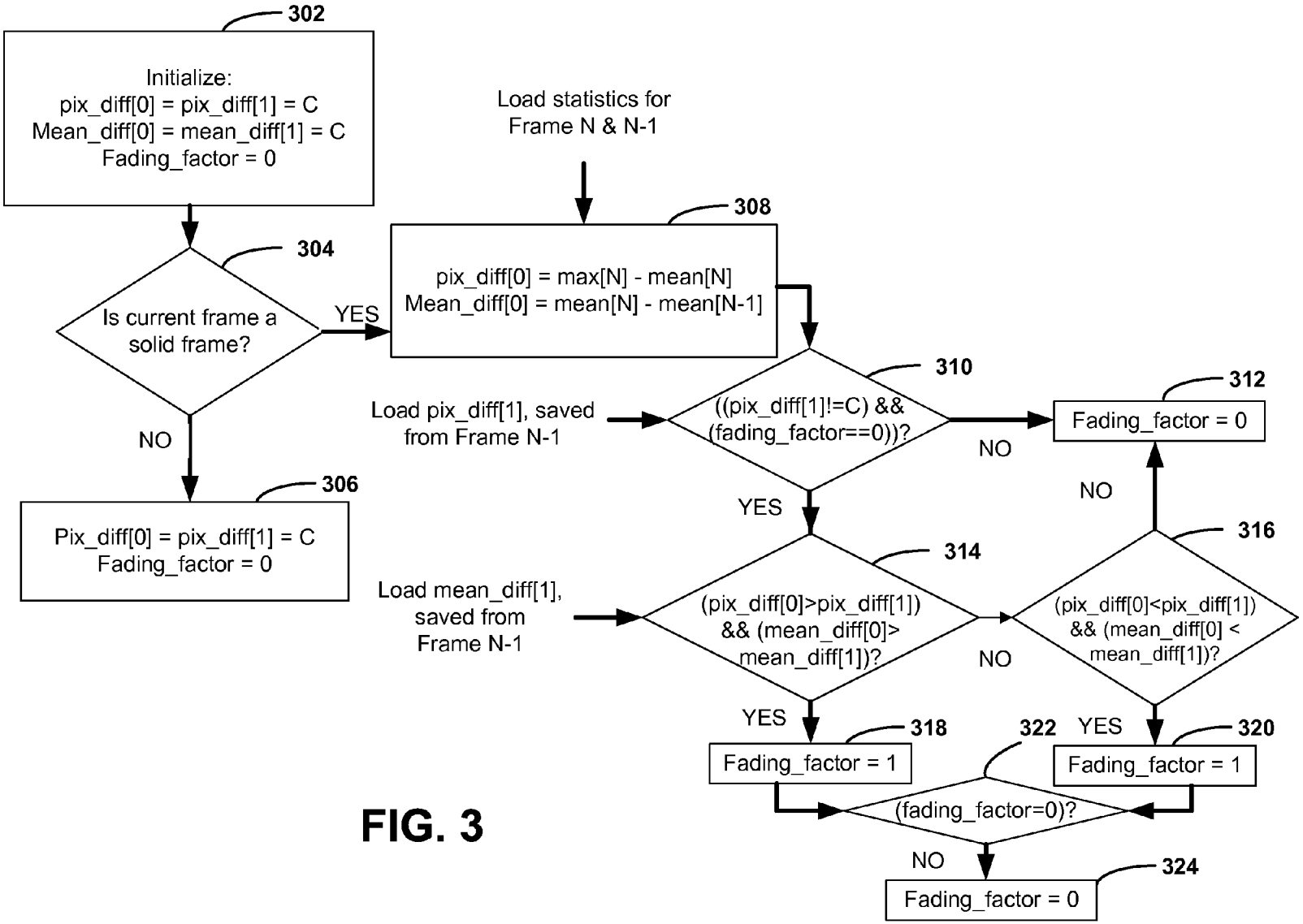
FIG. 3 is a flow diagram illustrating an example fade-in/fade-out detection scheme used by a flicker reduction algorithm in the process of FIG. 2B.

FIG. 3 illustrates an example fade-in/fade-out detection scheme used by the flicker reduction algorithm. According to the fade-in/fade-out detection scheme, several values are initialized to constant values (302). For example, pix_diff[0] and pix_diff[1] correspond to change in pixel values from frame(N−2) to frame(N−1) and from frame(N−1) to frame (N), respectively, and are both initialized to a constant, C (e.g., may be set to 255 for maximum contrast). pix_diff[0]

may indicate the global contrast of the current frame, i.e., max[N]−mean[N], and pix_diff[1] may indicate the global contrast of the previous frame, i.e., max[N−1]−mean[N−1] Similarly, mean_diff[0] and mean_diff[1] correspond to change in the mean value (e.g., the average of all pixel values in the frame or mean brightness of the frame) from frame(N−2) to frame(N−1) and from frame(N−1) to frame(N), respectively, and are both initialized to the constant, C. Additionally, fading_factor, indicative of fading from a previous frame, is initialized to 0. C may be set to 255 for maximum contrast, and as a result, fading detection may detect the scenario where the whole screen frame goes from purely dark to some content fading in. For purely dark images, the value of pix_diff and mean_diff is 0, and fade detection is triggered. For regular images, pix_diff and mean_diff are rarely both 255, so the value 255 may be set as an initial condition.

After initializing, a determination may be made whether or not the current frame is solid, e.g., purely dark or purely light (304). If the current frame is not solid, then pix_diff[0] and pix_diff[1] are set to the constant C and the fading_factor is set to 0 (306); therefore, no fading is detected. If the current frame is a solid frame, pix_diff[0] is set to the global contrast of the current frame, i.e., max[N]−mean[N], and mean_diff [0] is set to the difference between the means of frame N and frame N−1, or mean[N]−mean[N−1] (308). The scheme then determines whether pix_diff[1] is not C and fading_factor is 0 (310), where pix_diff[1] may be saved from the previous frame, N−1. If either pix_diff[1] is equal to C or fading_factor is not 0, then fading_factor is set to 0 (312), thus indicating no fading is detected. If both pix_diff[1] is not C and fading_factor is 0, a check is made whether pix_diff[0] is greater than pix_diff[1] and mean_diff[0] is greater than mean_diff[1] (314), where mean_diff[1] may be saved from the previous frame N−1.

If either pix_diff[0] is not greater than pix_diff[1] or mean_diff[0] is not greater than mean_diff[1], then another check is made whether pix_diff[0] is smaller than pix_diff[1] and mean_diff[0] is smaller than mean_diff[1] (316). If either pix_diff[0] is not smaller than pix_diff[1] or mean_diff[0] is not smaller than mean_diff[1], fading_factor is set to 0 (312), otherwise, fading_factor is set to −1 (320), which indicates fade out or content gradually becomes purely dark. If at 314 it is determined that pix_diff[0] is greater than pix_diff[1] and mean_diff[0] is greater than mean_diff[1], then fading_factor is set to 1 (318), which indicates fade in or content gradually appears from a purely dark scene. Therefore, after a fading in operation or fading out operation is detected, fading factor to may be reset to 0 to be prepared for the next fading detection.

Therefore, the fade-in/fade-out detection scheme determines if the original current frame is solid, and if it is and the global contrast is increasing from one frame to the next frame, a fade-in is detected. If the global contrast is decreasing from one frame to the next frame and the end frame is solid, a fade-out is detected. When fade-in or fade-out is detected, the lookup table (LUT) used to transform input pixel values from the input format to the output format, may be modified to smoothly transform frames from dark to bright or from bright to dark. In one example, for fading out, the content may become darker and darker, until the frame becomes purely dark, and for fading in, content may gradually appear from a purely dark scene, therefore pixel values may be modified to purely dark (fade out) or from purely dark (fade in) such that the change is smooth and gradual.

Figure 4:
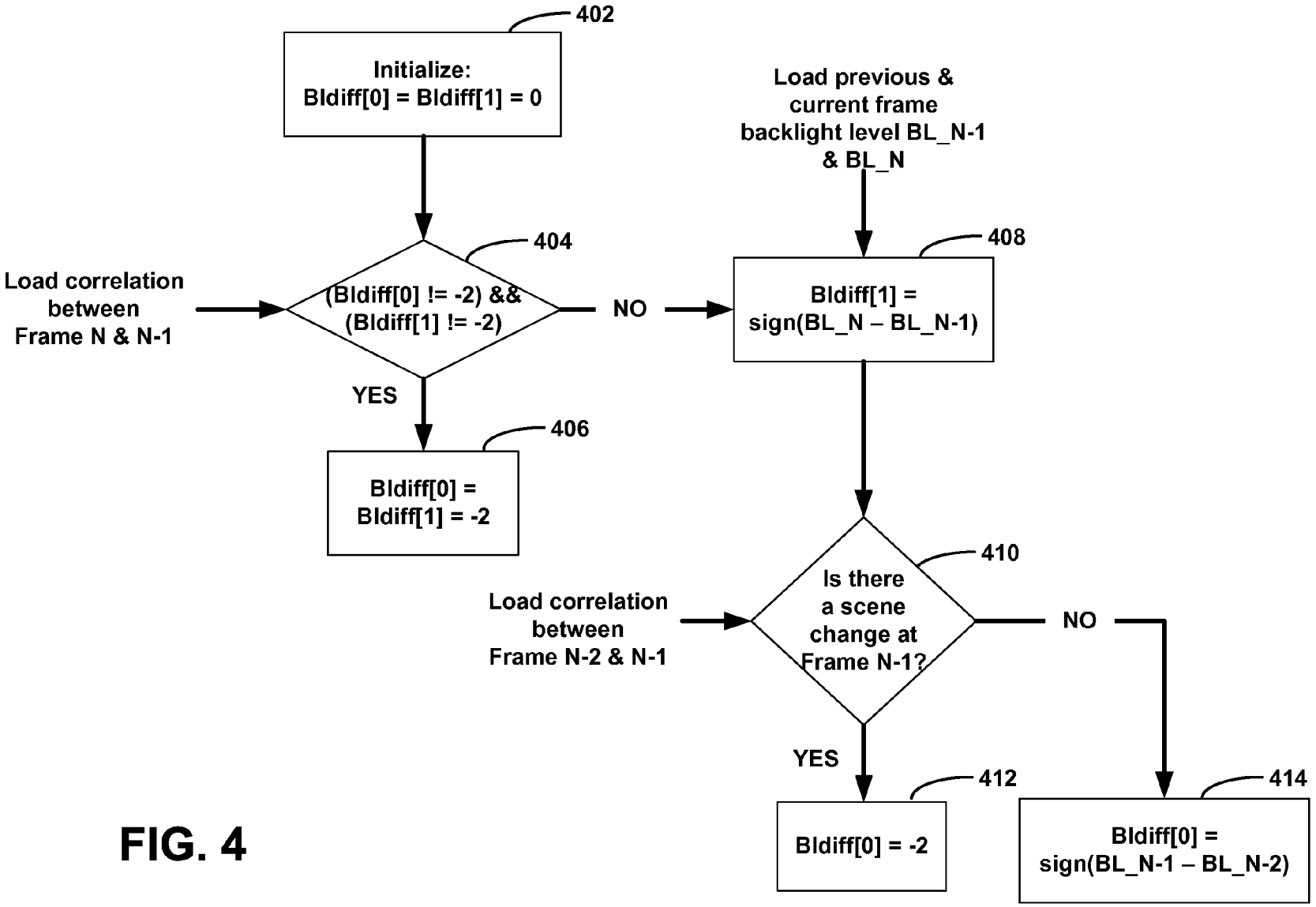
FIG. 4 is a flow diagram illustrating an example trend history calculation used by the flicker reduction algorithm in the process of FIG. 2B.

The flicker reduction algorithm may also determine the trend history of backlight between frames. FIG. 4 illustrates an example trend history calculation used by the flicker reduction algorithm. The flicker reduction algorithm may determine a historic backlight trend, which indicates the direction of change of backlight level from one frame to the next frame, e.g., increasing or decreasing from one frame to the next frame.

As FIG. 4 shows, initially BLdiff[0] and BLdiff[1] may be set to 0 (402), where BLdiff[0] and BLdiff[1], correspond to change of backlight level from frame(N−2) to frame(N−1) and from frame(N−1) to frame(N), respectively. In this implementation, the sign of the BLdiff value may indicate the direction of change of backlight level from one frame to another. A positive BLdiff indicates an increase in backlight level from frame to the next, a negative Bldiff indicates a decrease in backlight level, and a 0 Bldiff indicates no change.

After the first initialization, correlation between frame N and frame N−1 may be determined, as shown above in determining SIM. When the correlation is low, it indicates a scene change and the values of BLdiff[0] and BLdiff[1] are reset to −2. Otherwise, the value of BLdiff[0] and BLdiff[1] is the sign function of BL[n]−BL[n−1] or BL[n−1]−BL[n−2], which is 1 if positive, −1 if negative, and 0 if equal. The algorithm may check that neither BLdiff[0] nor BLdiff[1] is equal to a negative value, e.g., −2 (404), this determines whether there is a decrease in backlight level from frame N−2 to frame N−1 and from frame N−1 to frame N. If neither BLdiff[0] nor BLdiff[1] is negative, then both BLdiff[0] and BLdiff[1] are set to a negative value, e.g., −2 (406). Therefore, if, based on the similarity check, there has been a scene change at frame N from the previous frame N−1, then BLdiff [0] and BLdiff[1] are assigned a negative value (406), indicating that the initial backlight adjustment should be accepted for the current frame. In this case, no further analysis is required. In particular, temporal filtering according to the algorithm is terminated if there is a scene change and the initial backlight adjustment is accepted because flicker is not a concern when there is a scene change between frames. When there is a scene change, the content is already rapidly changing, such that the backlight adjustment is not noticeable.

If at least one of BLdiff[0] or BLdiff[1] is not negative, BLdiff[1] may be set to the sign of ($BL_N$−$BL_{N-1}$) (408), which indicates the direction of change of the backlight level from the previous frame(N−1), to the current frame(N). Processor 102, in executing this algorithm, may then determine whether there is a scene change at frame N−1 (410), based on the correlation between frames N−1 and N−2. If there is a scene change, then BLdiff[0] is set to a negative value (412), otherwise, BLdiff[0] is set to the sign of ($BL_{N-1}$−$BL_{N-2}$) (414), which indicates the direction of change of the backlight level from frame N−2 to frame N−1.

Therefore, if there is no scene change, temporal analysis may be performed to determine whether the initial backlight adjustment should be accepted (e.g., if the adjustment follows a historical trend of increasing or decreasing backlight level) or rejected and modified (e.g., if the adjustment would contradict a historical trend and, consequently, cause flicker). If no scene change is detected, then BLdiff[1] is positive if frame(N) has greater backlight level than frame(N−1), negative if the frame(N) has smaller backlight level than frame (N−1), and 0 if frame(N) and frame(N−1) have the same backlight level. The same calculation may be used to determine BLdiff[0] corresponding to the backlight level change from frame(N−2) to frame(N−1).

The trend calculation for history backlight or brightness change is different for LCD and AMOLED displays. In LCD displays, the backlight level is the input, while the brightness change ratio (>1 or <1) is the input for AMOLED. The example of FIG. 4 is applicable to displays with global backlight change, but the same process may be applicable to displays with local backlights.

As noted above, temporal filtering may be applied to both pixel value scaling and backlight level adjustment to provide flicker reduction. Using the determinations regarding the similarity check and the trend history, the algorithm may provide the temporal information associated with the current frame and one or more previous frames to perform temporal filtering on the pixels of the current frame and temporal filtering on the backlight level. Temporal filtering on the pixels provides a transformed frame with pixels scaled to accommodate the filtered (or adjusted) backlight level.

For pixel value scaling, where an LUT may be used to represent pixel values of a frame, the transformed pixel values $LUT_{final}$ of an output frame may be determined according to the following equation:

$$LUT_{final}=\omega*LUT_{curr}+(1-\omega)*LUT_prev$$

where ω is a scale factor and may be determined based on the correlation between two consecutive frames, $LUT_{curr}$ and $LUT_{prev}$, which is based on SIM, discussed above. The determination of the correlation between the two frames may be based on the similarity check calculation, shown above. If two consecutive frames are similar, then the correlation between the two frames is higher, and ω is closer to 0. If two consecutive frames are very different, then the correlation between the two frames is lower, and ω is closer to 1. Therefore, ω for a current frame may be a function of correlation between the current frame and the previous frame.

The temporal filtering as applied to backlight determination depends on the correlation between consecutive frames and the trend of history calculation (FIG. 4), both described above. Backlight level changes may be determined between consecutive frames and recorded as a trend, as long as there is no scene change. A scene change between frames results in resetting the trend, as shown in FIG. 4 above, e.g., a negative BLdiff indicates a reset in trend.

Figure 5:
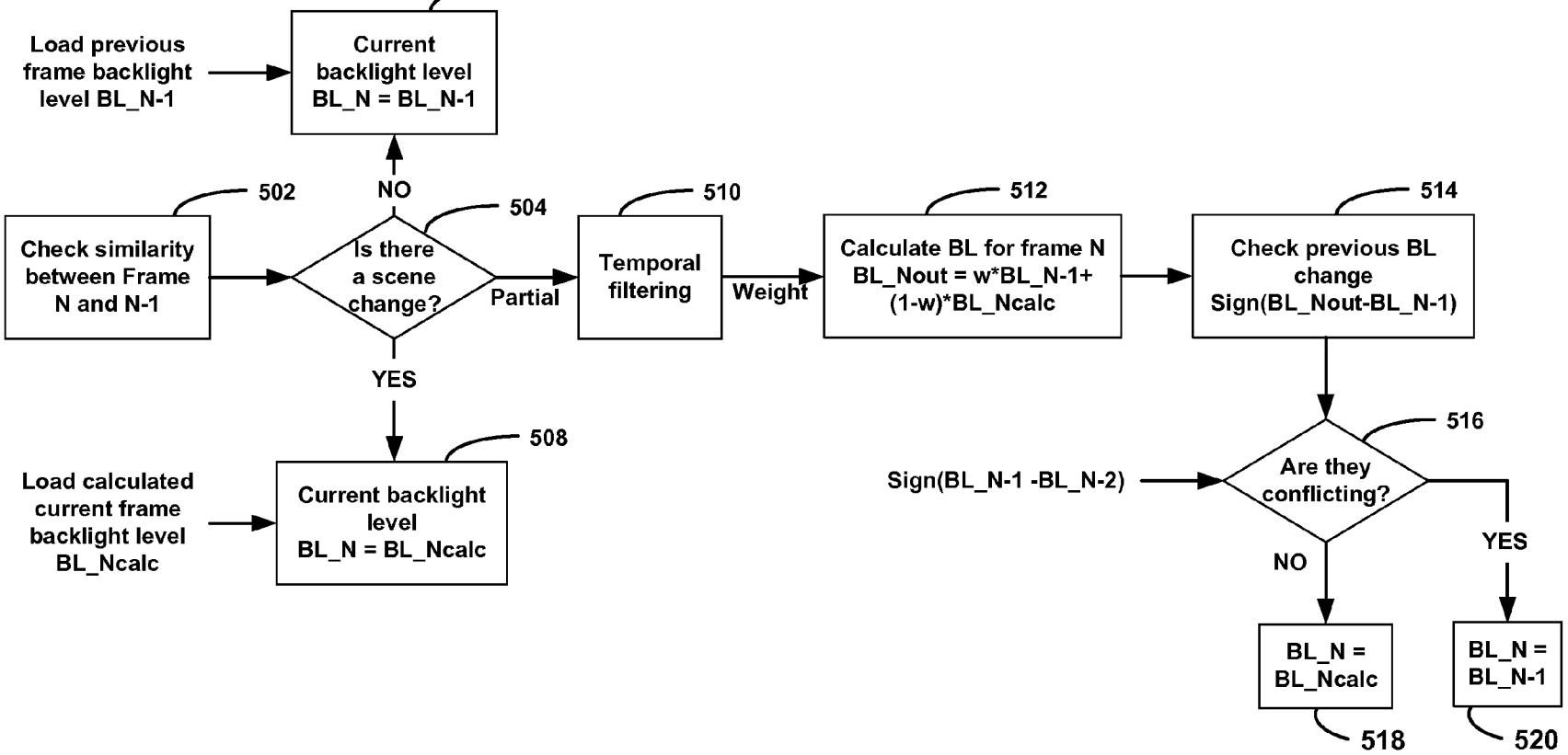
FIG. 5 illustrates example algorithm performed by a processor to implement temporal filtering of illumination level.

FIG. 5 illustrates example algorithm performed by a processor (e.g., processor 102 of FIG. 1) to implement temporal filtering on backlight level. While described with respect to an algorithm that performs operations, it should be understood that the algorithm is implemented by a processor to cause, or configure the processor to perform the operations attributed to the algorithm.

Initially, the algorithm may check similarity between frame(N−1) and frame(N), as described above (502). A check is then made to determine whether there is a scene change from frame(N−1) to frame(N) (504). If there is no scene change between frame(N) and frame(N−1), the backlight level of the previous frame, $BL_{N-1}$, may be loaded and the backlight level of the current frame, $BL_N$, may be set to $BL_{N-1}$ (506). In this way, two frames that have the same scene are displayed at the same backlight level. If there is a complete scene change from frame(N−1) to frame(N), the backlight level of frame(N), $BL_N$, is set to the calculated backlight level, $BL_{Ncalc}$, i.e., the initial backlight level adjustment determined by the algorithm (508). As noted above, when there is a complete scene change, a change in the backlight level does not cause flicker, or flicker is not noticeable because of the change in the scene.

If there is partial scene change between frame(N) and frame(N−1), then temporal filtering (equation for temporal shown below to determine the new backlight level) is used (510). Partial scene change indicates that consecutive frames are neither identical nor completely different. Partial scene change determination may be based on a range of values of SIM (similarity check) between 0 and 1, and the range may be adjusted based on user preference.

The weight used in the calculation of the backlight level adjustment is determined based on the trend between the frames, as described above. The new backlight level for current frame(N), $BL_{Nout}$, may be determined according to the following equation (512), when there is a partial scene change:

$$BL_{Nout}=\omega*BL_{N-1}+(1-\omega)*BL_{Ncalc}$$

where the weight ω is determined based on the correlation between the current frame and the previous frame.

The new backlight level, $BL_{Nout}$, may then be compared to the backlight level of the previous frame to determine the direction of backlight change (i.e., increasing or decreasing), which may be indicated by the sign of the change from $BL_{N-1}$ to $BL_{Nout}$ (514). The direction of change may then be compared to the direction of change between the backlight levels of the previous two frames, N−2 and N−1 (516). If the direction of change is not conflicting between the current frame and the previous frame versus between the two previous frames, then the backlight level for frame(N) is set to the new value, $BL_{Ncalc}$ (518). If the direction of change is conflicting, then the backlight level for frame(N) is set to the backlight level of the previous frame(N−1), $BL_{N-1}$ (520). In this manner, the historical trend of backlight level adjustment is maintained, and flicker can be avoided.

The techniques described in this disclosure may be implemented, at least in part, in hardware, software, firmware or any combination of hardware, software, and/or firmware. For example, various aspects of the described techniques may be implemented within one or more processors, including one or more microprocessors, digital signal processors (DSPs), application specific integrated circuits (ASICs), field programmable gate arrays (FPGAs), or any other equivalent integrated or discrete logic circuitry, as well as any combinations of such components. The term "processor" or "processing circuitry" may generally refer to any of the foregoing logic circuitry, alone or in combination with other logic circuitry, or any other equivalent circuitry. A control unit comprising hardware may also perform one or more of the techniques of this disclosure.

Such hardware, software, and firmware may be implemented within the same device or within separate devices to support the various operations and functions described in this disclosure. In addition, any of the described units, modules or components may be implemented together or separately as discrete but interoperable logic devices. Depiction of different features as modules or units is intended to highlight different functional aspects and does not necessarily imply that such modules or units must be realized by separate hardware or software components. Rather, functionality associated with one or more modules or units may be performed by separate hardware, hardware and firmware, and/or hardware and software components, or integrated within common or separate hardware components or a combination of hardware and software components.

The techniques described in this disclosure may also be embodied or encoded in a computer-readable medium, such as a computer-readable storage medium, containing instructions. Instructions embedded or encoded in a computer-readable medium may cause one or more programmable processors, or other processors, to perform the method, e.g., when the instructions are executed. Computer readable storage media may include random access memory (RAM), read only memory (ROM), programmable read only memory (PROM), erasable programmable read only memory (EPROM), electronically erasable programmable read only memory (EEPROM), flash memory, a hard disk, a CD-ROM, a floppy disk, a cassette, magnetic media, optical media, or other non-transitory computer readable media.

In an exemplary implementation, techniques described in this disclosure may be performed by a digital video coding hardware apparatus, whether implemented in part by hardware, hardware and firmware and/or hardware and software.

Various aspects and examples have been described. However, modifications can be made to the structure or techniques of this disclosure without departing from the scope of the following claims.

What is claimed is:

1. A method of controlling an illumination level of a display, the method comprising:

receiving an initial illumination level adjustment for a current video frame in a sequence of video frames to be presented by the display;

determining a weight based on a correlation between the current video frame and a preceding video frame in the sequence;

determining a first illumination level for the current video frame based on the weight, the initial illumination level adjustment for the current frame, and an illumination level of one or more preceding video frames in the sequence;

determining a first trend based on a direction of backlight change between the first illumination level and the illumination level of one of the preceding video frames;

determining a second trend based on a direction of backlight change between the illumination level of one of the preceding video frames and the illumination level of another preceding video frame;

determining a second illumination level for the current video frame, the second illumination level comprising the first illumination level based on the first trend and the second trend not conflicting or comprising the illumination level of one of the preceding video frames based on the first trend and the second trend conflicting; and applying the determined second illumination level for the current video frame.

2. The method of claim 1, further comprising:

determining whether there is complete scene change, there is no scene change, or there is partial scene change from the preceding video frame to the current video frame, wherein determining the weight comprises determining the weight when there is partial scene change, and wherein determining the first illumination level comprises determining the first illumination level when there is partial scene change.

3. The method of claim 1, further comprising calculating new pixel values for the current video frame based on a degree of similarity between the current video frame and the preceding video frames.

4. The method of claim 1, further comprising adjusting pixel values of the current video frame based on the determined second illumination level.

5. The method of claim 1, wherein the display comprises an LCD and the illumination level comprises a backlight level.

6. The method of claim 1, wherein the display comprises an OLED and the illumination level comprises a backlight level.

7. The method of claim 1, wherein the weight is a scale factor used to determine an effect of the initial illumination level adjustment and the illumination level of the one or more preceding video frames on the first illumination level.

8. A device for displaying a current video frame in a sequence of video frames presented by the device, the device comprising one or more processors configured to:

receive an initial illumination level adjustment for the current video frame in the sequence of video frames to be presented by the device;

determine a weight based on a correlation between the current video frame and a preceding video frame in the sequence;

determine a first illumination level first the current video frame based on the weight, the initial illumination level adjustment for the current frame, and an illumination level of one or more preceding video frames in the sequence;

determine a first trend based on a direction of backlight change between the first illumination level and the illumination level of one of the preceding video frames;

determine a second trend based on a direction of backlight change between the illumination level of one of the preceding video frames and the illumination level of another preceding video frame;

determine a second illumination level for the current video frame, the second illumination level comprising the first illumination level based on the first trend and the second trend not conflicting or comprising the illumination level of one of the preceding video frames based on the first trend and the second trend conflicting; and apply the determined second illumination level for the current video frame.

9. The device of claim 8, wherein the one or more processors are further configured to:

determine whether there is complete scene change, there is no scene change, or there is partial scene change from the preceding video frame to the current video frame, wherein, to determine the weight, the one or more processors are configured to determine the weight when there is partial scene change, and wherein, to determine the first illumination level, the one or more processors are configured to determine the first illumination level when there is partial scene change.

10. The device of claim 8, wherein the one or more processors are further configured to calculate new pixel values for the current video frame based on a degree of similarity between the current video frame and the preceding video frames.

11. The device of claim 8, wherein the one or more processors are further configured to adjust pixel values of the current video frame based on the determined second illumination level.

12. The device of claim 8, further comprising an LCD, wherein the illumination level comprises a backlight level.

13. The device of claim 8, further comprising an OLED, wherein the illumination level comprises a brightness level.

14. The device of claim 8, wherein the weight is a scale factor used to determine an effect of the initial illumination level adjustment and the illumination level of the one or more preceding video frames on the first illumination level.

15. A device for displaying a current video frame in a sequence of video frames presented by the device, the device comprising:

means for receiving an initial illumination level adjustment for the current video frame in the sequence of video frames to be presented by the device;

means for determining a weight based on a correlation between the current video frame and a preceding video frame in the sequence;

means for determining a first illumination level for the current video frame based on the weight, the initial illumination level adjustment for the current frame, and an illumination level of one or more preceding video frames in the sequence;

means for determining a first trend based on a direction of backlight change between the first illumination level and the illumination level of one of the preceding video frames;

means for determining a second trend based on a direction of backlight change between the illumination level of one of the preceding video frames and the illumination level of another preceding video frame;

means for determining a second illumination level for the current video frame, the second illumination level comprising the first illumination level based on the first trend and the second trend not conflicting or comprising the illumination level of one of the preceding video frames based on the first trend and the second trend conflicting; and means for applying the determined second illumination level for the current video frame.

16. The device of claim 15, further comprising:

means for determining whether there is complete scene change, there is no scene change, or there is partial scene change from the preceding video frame to the current video frame, wherein the means for determining the weight comprise means for determining the weight when there is partial scene change, and wherein the means for determining the first illumination level comprises means for determining the first illumination level when there is partial scene change.

17. The device of claim 15, further comprising means for calculating new pixel values for the current video frame based on a degree of similarity between the current video frame and the preceding video frames.

18. The device of claim 15, further comprising means for adjusting pixel values of the current video frame based on the determined second illumination level.

19. The device of claim 15, wherein the weight is a scale factor used to determine an effect of the initial illumination level adjustment and the illumination level of the one or more preceding video frames on the first illumination level.

20. A computer-readable storage medium comprising instructions that, when executed, cause a processor in a device for displaying a current video frame in a sequence of video frames presented by a display to:

receive an initial illumination level adjustment for the current video frame in the sequence of video frames to be presented by the display;

determine a weight based on a correlation between the current video frame and a preceding video frame in the sequence;

determine a first illumination level for the current video frame based on the weight, the initial illumination level adjustment for the current frame, and an illumination level of one or more preceding video frames in the sequence;

determine a first trend based on a direction of backlight change between the first illumination level and the illumination level of one of the preceding video frames;

determine a second trend based on a direction of backlight change between the illumination level of one of the preceding video frames and the illumination level of another preceding video frame;

determine a second illumination level for the current video frame, the second illumination level comprising the first illumination level based on the first trend and the second trend not conflicting or comprising the illumination level of one of the preceding video frames based on the first trend and the second trend conflicting; and apply the determined second illumination level for the current video frame.

21. The computer-readable storage medium of claim 20, further comprising instructions that cause the processor to:

determine whether there is complete scene change, there is no scene change, or there is partial scene change from the preceding video frame to the current video frame, wherein the instructions that cause the processor to determine the weight comprise instructions that cause the processor to determine the weight when there is partial scene change, and wherein the instructions that cause the processor to determine the first illumination level comprise instructions that cause the processor to determine the first illumination level when there is partial scene change.

22. The computer-readable storage medium of claim 20, further comprising instructions that cause the processor to calculate new pixel values for the current video frame based on a degree of similarity between the current video frame and the preceding video frames.

23. The computer-readable storage medium of claim 20, further comprising instructions that cause the processor to adjust pixel values of the current video frame based on the determined second illumination level.

24. The computer-readable storage medium of claim 20, wherein the weight is a scale factor used to determine an effect of the initial illumination level adjustment and the illumination level of the one or more preceding video frames on the first illumination level.

* * * * *